US005841880A

United States Patent [19]

Sakamoto

[11] Patent Number: 5,841,880

[45] Date of Patent: Nov. 24, 1998

[54] MULTI-POINT DRIVE TYPE SPEAKER

[75] Inventor: Yoshio Sakamoto, Hachiouji, Japan

[73] Assignee: Kabushiki Kaisha Kenwood, Tokyo, Japan

[21] Appl. No.: 707,295

[22] Filed: Sep. 3, 1996

[30] Foreign Application Priority Data

Sep. 4, 1995 [JP] Japan ..... 7-248291

[51] Int. Cl.[6] ..... H04K 25/00

[52] U.S. Cl. ..... 381/401; 381/407; 381/422; 381/424

[58] Field of Search ..... 381/199, 194, 381/192, 182, 202, 184, 186

[56] References Cited

U.S. PATENT DOCUMENTS 2,197,649 4/1940 Neuscholtz ..... 381/199

2,551,556 9/1951 Brennan ..... 381/182

5,594,805 1/1997 Sakamoto et al. ..... 381/199

5,682,436 10/1997 Sakamoto et al. ..... 381/199

*Primary Examiner*—Sinh Tran

*Attorney, Agent, or Firm*—Sixbey, Friedman, Leedom & Ferguson, PC; Gerald J. Ferguson, Jr.; Eric J. Robinson

[57] ABSTRACT

A light and cost effective speaker is provided which is suitable for a vehicle mount speaker, thin, and has a broad reproduction frequency band. Like a cone diaphragm and a center cap or the like, the cone diaphragm having a valley at the junction point with the center cap is integrally mounted with the center cap, and a plurality of voice coils, preferably three or more voice coils, are radially disposed along the valley or at the area near the valley to drive the diaphragm.

2 Claims, 11 Drawing Sheets

MULTI-POINT DRIVE TYPE SPEAKER

BACKGROUND OF THE INVENTION

1. Field of the Invention

The present invention relates to a multi-point drive type speaker which drives a diaphragm with a plurality of voice coils.

2. Related Background Art

A conventional general cone type speaker is of the one-point drive type that the central base portion of a cone diaphragm is driven with a single voice coil. In order to thin a speaker, the half apex angle of a diaphragm is required to be made as small as possible, i.e., the cone is required to be as shallow as possible. The diaphragm is desired to be ultimately planar.

Assuming that a diaphragm has the same diameter and material, the narrower the half apex angle, i.e., the deeper the cone, the wider the reproduction frequency band and the broader the high frequency band can be reproduced. On the other hand, the wider the half apex angle, i.e., the shallower the cone, the narrower the reproduction band.

The present inventors have proposed a multi-point driver type speaker which solves the above problems of a conventional speaker (Japanese Patent Application No. 6-147046). This speaker drives a planer diaphragm with a plurality of voice coils and uses repulsion magnetic circuits with a repulsion magnetic field generated at the outer peripheral area of a center plate of magnetic material disposed between two magnets with the same polarities being faced each other. In this patent specification, another embodiment is also proposed which shows an example of application to a cone type speaker.

This multi-point speaker can be extremely thinned and the reproduction frequency band can be made wider than a one-point drive type speaker. The present invention has developed and improved a multi-point drive type speaker previously proposed to be most suitable for a vehicle door mount speaker.

FIGS. 8A and 8B show an example of a one-point drive type speaker (hereinafter called a "one-point drive type planar speaker SP1") using a conventional planar diaphragm 1*f*. At the center of the planar diaphragm 1*f*, a voice coil 2 is disposed which is driven by a repulsion magnetic circuit. The configuration of FIG. 8 was published in JP Laid-open Patent Gazette No. 06-28499 and is disclosed in U.S. patent application Ser. No. 08/219,528 filed on Mar. 29, 1994 and assigned to the same assignee as that of the present application. The repulsion magnetic circuit has a center plate 5 made of magnetic material disposed between two magnets M1 and M2 with the same polarities facing each other. The voice coil 2 is disposed in a repulsion magnetic field generated at the peripheral area of the center plate 5.

This one-point drive type planar speaker SP1 has a high frequency limit of about 700 to 900 Hz in the reproduction frequency band which is too narrow if the speaker is used as a general 2-way speaker. This speaker can be used therefore only as a low frequency band speaker.

For the comparison purpose, the present inventors manufactured a thin low frequency speaker system having the above configuration with a height of 728 mm, a width of 1028 mm, and a depth of 30 mm.

In order to improve the performance of the one-point drive type planar speaker SP1, a multi-point drive type planar speaker SP3 such as shown in FIGS. 9A and 9B was manufactured. In this configuration, a planar diaphragm if generally the same as that of the one-point drive type planar speaker SP1 is used and driven at three points with a combination of three voice coils 2 and three repulsion magnetic circuits. This multi-point drive type planar speaker SP3 had a high frequency limit of about 2000 to 3000 Hz, was able to use as a woofer of a 2-way speaker system, and a vehicle door mount speaker system with a tweeter was actually manufactured.

Light and thin vehicle mount speakers have long been desired. Particularly nowadays, an impact beam device for collision safety, a power window motor, or the like is mounted in the inside of a vehicle door. Therefore, the space in the door is very small as compared to a door used before, and a door mount speaker having a good space factor is now desired more than before. In this context, the multi-point drive type planar speaker SP3 is thin and the requirement of the space factor can be met. However, a 2-way speaker system with a tweeter is necessary because of the present performance (reproduction frequency band), and the cost of the speaker system becomes high.

As vehicle mount speakers, the multi-point drive type planar speaker SP3 has the following advantages over a generally used one-point drive type planar speaker SP1. First, since a planar diaphragm is used, the half apex angle is zero and the speaker can be made ultimately thin. Second, since the planar diaphragm is used, the front shape can be set arbitrarily. Third, since the planar diaphragm is used, the drive points of the diaphragm can be selected as desired. The disadvantages are as follows. First, fractional vibrations are more likely to occur than a cone so that the diaphragm is required to be thick, increasing the weight of the diaphragm. Second, since there is no half apex angle, it is difficult to raise the high frequency limit.

Therefore, if the number of drive points is increased and an auxiliary diaphragm 1*s* called a wither or the like is mounted, such as shown in FIGS. 10A and 10B, the high frequency limit can be raised without changing the diaphragm shape of the multi-point drive type planar speaker SP3 and the speaker can be used as a full-range one-point drive type cone speaker or the like. In FIG. 10B, reference numeral 6 represents a frame.

With these means, however, the numbers of magnetic circuits, voice coils, and the like increase so that the cost is raised and the weight of the speaker increases. In addition, mounting the auxiliary diaphragm ls increases the mount depth, contradicting thinning the speaker, and increases the cost.

As a result, the simplest method of raising the high frequency limit is to use a diaphragm with a half apex angle, i.e., a cone diaphragm. However, this approach is very disadvantageous from the viewpoint of thinning and lightening a speaker. FIGS. 11A and 11B show an example of the configuration of a multi-point drive type cone speaker SP2 which drives a cone diaphragm 1*c* of a general cone type speaker at multiple points. This configuration has been disclosed as an example of application of the multi-point drive type speaker the inventors have proposed previously. However, driving such a cone 1*c* at multiple points results in a large mount depth of the cone and is not suitable for thinning. The configurations of FIG. 9A–FIG. 11B are disclosed in copending U.S. application Ser. No. 08/451,497 filed on May 26, 1995 which was assigned to the same assignee as that of the present application.

SUMMARY OF THE INVENTION

It is an object of the present invention to provide a speaker which is an improved modification of the multi-point drive type planar speaker SP3 the inventors have proposed, is thin enough to be suitable for a vehicle mount speaker, has a reproduction frequency band equivalent to a generally used full range one-point drive type cone speaker, and is lighter than a conventional one-point drive type cone speaker and less expensive than the multi-point drive type planar speaker SP3.

In order to solve the above object of the invention, like a cone diaphragm and a center cap or the like, the cone diaphragm having a valley at the junction point with the center cap is integrally mounted with the center cap, and a plurality of voice coils, preferably three or more voice coils, are radially disposed along the valley or at the area near the valley to drive the diaphragm.

The voice coil is driven by a repulsion magnetic circuit. A flat area is formed at the bottom of the valley area of the diaphragm. An adhesive margin formed at the end portion of a suspension such as a damper for supporting the diaphragm is adhered to the flat area. A corrugation portion of the damper is positioned under a dome.

The diaphragm is formed with a horizontal surface at the area where the voice coil is mounted. A sloped area with an inclination angle relative to the horizontal surface is formed continuously with the horizontal surface. A cut-away area is formed in the diaphragm at the horizontal surface or at the sloped area and the voice coil is disposed at the cut-away area.

An edge, a diaphragm mount, and the suspension may be molded integrally to adhere the integral mold to the diaphragm.

BRIEF DESCRIPTION OF THE DRAWINGS

FIG. 1A is a plan view of a diaphragm, and FIG. 1B is a cross sectional view taken along line A—A of FIG. 1A.

FIG. 2A is a plan view of the speaker frame, and FIG. 2B is a cross sectional view taken along line A—A of FIG. 2A.

FIG. 3A is a plan view thereof, and FIG. 3B is a cross sectional view taken along line A—A of FIG. 3A.

FIG. 4A is a cross sectional view of the diaphragm assembly, FIG. 4B is a cross sectional view of the frame, and FIG. 4C is a cross sectional view illustrating the mount state.

FIG. 6A is a plan view thereof, and FIG. 6B is a cross sectional view taken along line A—A of FIG. 6A.

FIG. 7A is a cross sectional view of the diaphragm, FIG. 7B is a cross sectional view of the integral mold of the edge, damper, and diaphragm mount, and FIG. 7C is a cross sectional view showing the mount state of the diaphragm.

FIG. 8A is a plan view thereof, and FIG. 8B is a cross sectional view taken along line A—A of FIG. 8A.

FIG. 9A is a plan view thereof, and FIG. 9B is a cross sectional view taken along line A—A of FIG. 8A.

FIG. 10A is a plan view thereof, and FIG. 10B is a cross sectional view taken along line A-B of FIG. 10A.

FIG. 11A is a plan view thereof, and FIG. 11B is a cross sectional view taken along line A-0-B of FIG. 11A.

DETAILED DESCRIPTION OF THE PREFERRED EMBODIMENTS

Figure 1A:
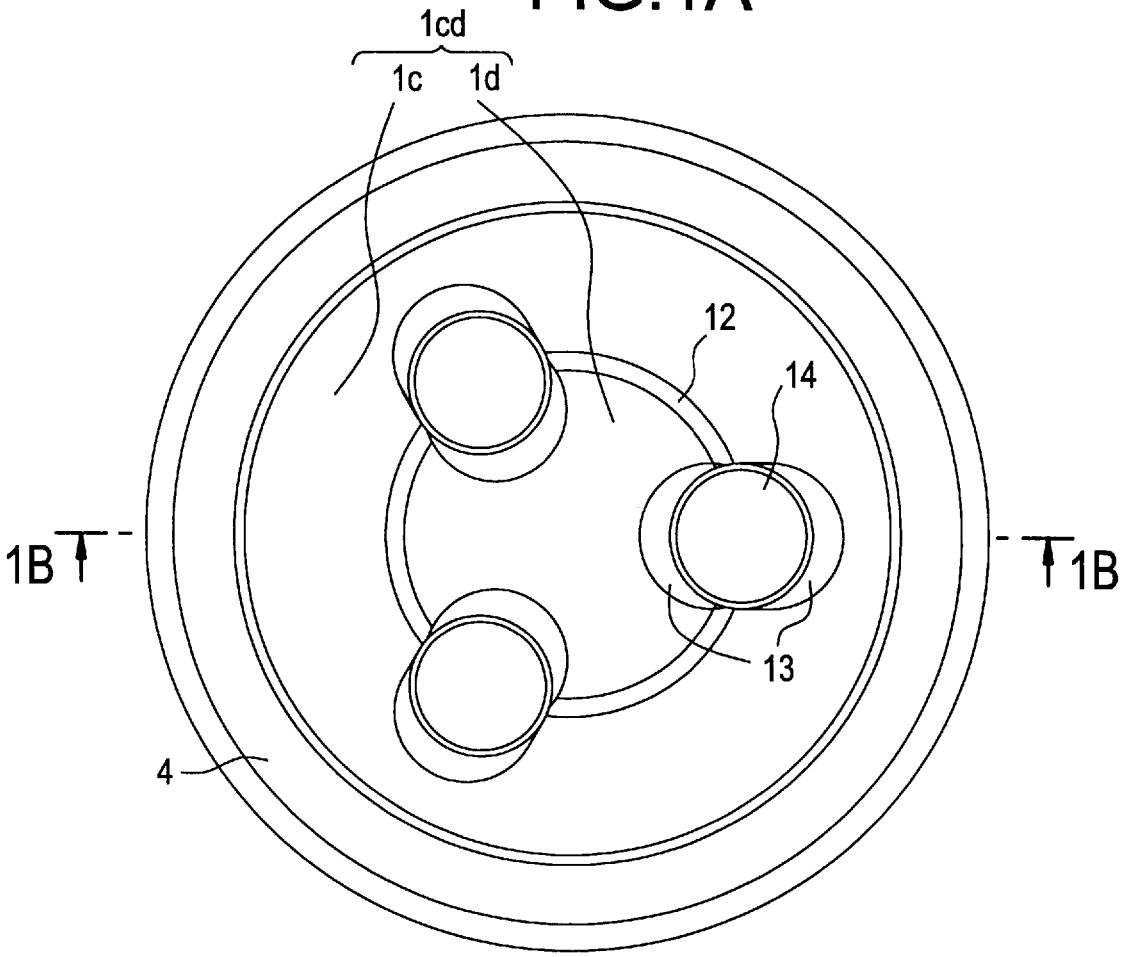
FIGS. 1A and 1B show a speaker according to an embodiment of the invention.

Embodiments of a speaker will be described with reference to FIGS. 1A to 7C. Like constituent elements to conventional speakers described with reference to FIGS. 8A to 11B are represented by using identical reference numerals and the description thereof is omitted.

Figure 1B:
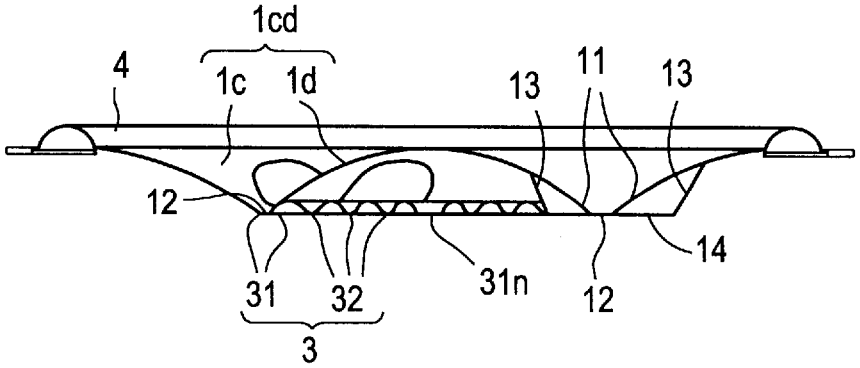

A diaphragm 1*cd* of 107 mm diameter is made of paper board and has generally a shallow W-character shape as shown in FIG. 1B. A valley 11 of 10.9 mm deep is formed at the position remote by 27.8 mm in the radial direction from the center of the diaphragm 1*cd*.

A horizontal adhesive margin 12 of about 3 mm wide is formed at the valley 11. Lines coupling both sides of the adhesive margin 12 to the center apex and outer apex of the diaphragm 1*cd* form curves having a radius of 60 mm, the portion between the adhesive margin 12 of the valley 11 and the outer apex forms a cone 1*c* and the portion between the adhesive margin 12 and the center apex forms a dome 1*d*. The cone 1*c* and dome 1*d* constitute an integral mold of the diaphragm 1*cd*.

As shown in the plan view of FIG. 1A, three voice coil mounts 14 are formed at an interval of 120 degrees around the central circumference of the adhesive margin 12 of the valley 11 remote from the center of the diaphragm 1*cd* by 27.8 mm. Each voice coil mount 14 has a circular flat portion of 22 mm diameter and a hole formed in the flat portion and having a diameter (in this embodiment, 20.5 mm diameter) corresponding to the maximum diameter of a voice coil 2. As shown in the cross sectional view of FIG. 1B, the voice coil mount 14 has a conical slope 13 with an inclination angle of about 30 degrees, the slope 13 extending outward and upward from the outer periphery of the circular flat portion of 22 mm diameter. This slope 13 forms a rib of the dome 1*d* and cone 1*c*. The weight of the diaphragm 1*cd* after trimming is about 2 grams.

This diaphragm 1*cd* has some depth. Therefore, if the configuration of an edge 4 of the multi-point drive type flat plate speaker SP3 the inventors have proposed is used, rolling may occur at a large amplitude. In order to prevent rolling, a suspension mechanism is provided like a general speaker by forming an edge 4 at the outer circumference of the diaphragm and a damper 3 at the valley 11 of the diaphragm. In this embodiment, the edge 4 generally called a roll edge is attached to the outer circumference of the diaphragm 1*cd*, the edge 4 having a width of about 9.5 mm, a height of 3.6 mm, and a radius of 3.6 mm.

The damper 3 has a diameter of 58 mm, an adhesive portion 31 formed at its outer circumference, and a corrugation portion 32 having a height of about 2.4 mm and a corrugation pitch of about 2.8 mm. The damper 3 is molded so that the adhesive margin 31 and part of the outermost corrugation face the adhesive margin 12 and part of the plane of the dome 1*d* of the diaphragm. The damper 3 is disposed under the dome 1*d* as shown in the cross sectional view of FIG. 1B, and at the same time when the edge 4 is adhered to the diaphragm, the adhesive margin 31 of the damper and part of the outermost corrugation are adhered to the adhesive margin 12 at the valley 11 and part of the plane of the dome 1*d* of the diaphragm. If the damper 3 without trimming after the molding is adhered to the diaphragm, the voice coil mount 14 and part of the corrugation portion 32 interfere each other. Therefore, this interference portion is cut off during the damper trimming work.

The diaphragm 1*cd* with the edge 4 and damper 3 adhered thereto and the voice coil 2 are assembled by mounting them on a predetermined assembly jig. The voice coil 2 has a coil inner diameter of 20.44 mm and a winding width of about 6 mm. As the voice coil 2 is mounted on the jig, the outer circumferential surface of the voice coil 2 is correctly fitted in the voice coil mount 14. Therefore, after the lead wires of the voice coil 2 are subjected to electrical connection, the outer circumferential surface of the voice coil 2 and the diaphragm 1*cd* are adhered together to complete a diaphragm assembly 1A with the voice coil 2 and suspension mechanism (edge 4 and damper 3) being mounted.

Figure 2A:
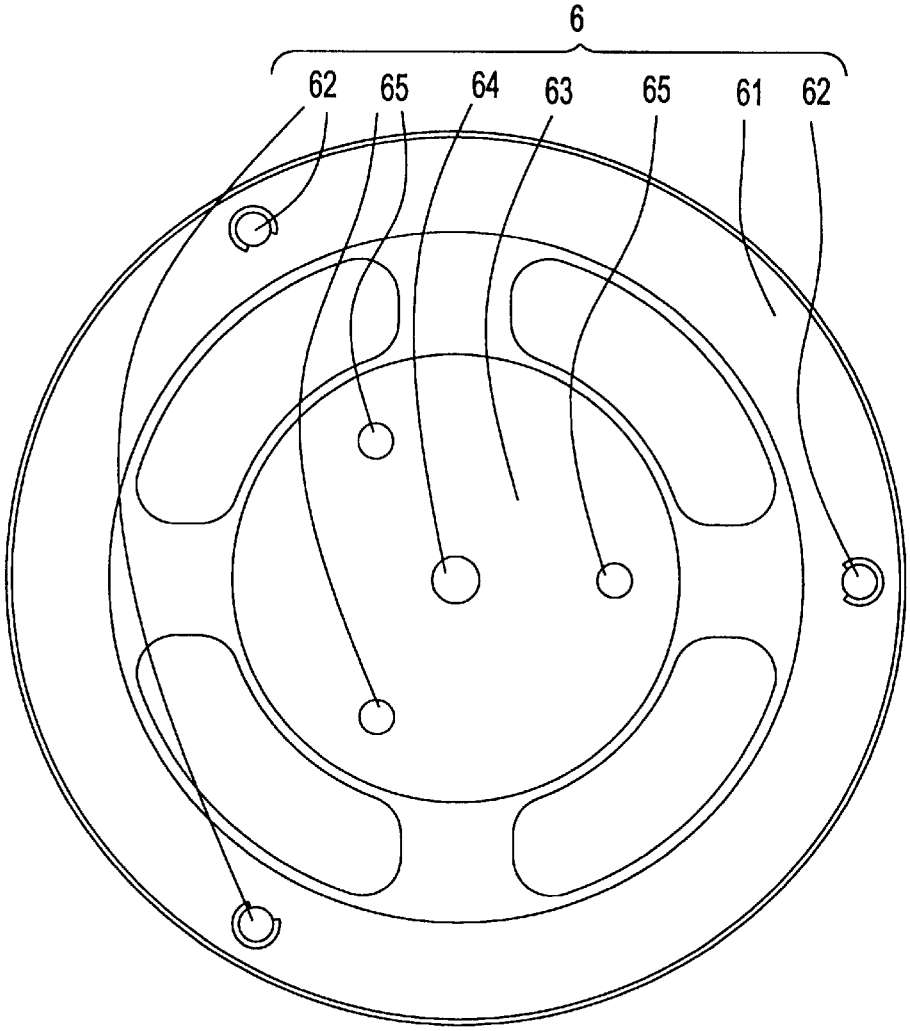
FIGS. 2A and 2B show a speaker frame.
Figure 2B:
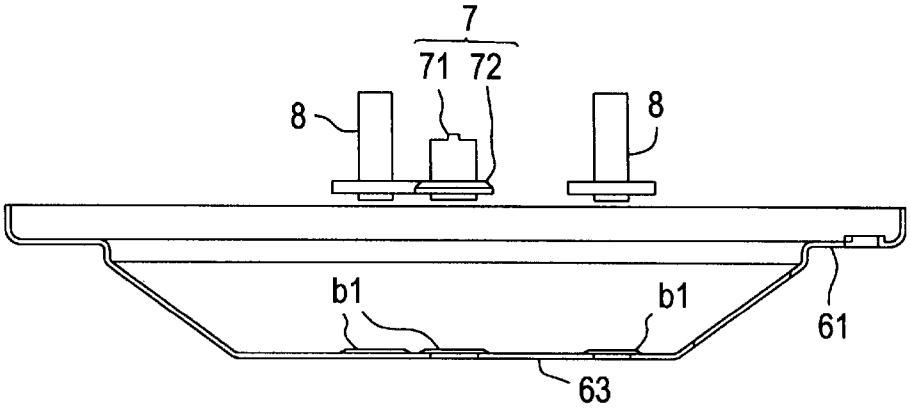

As shown in FIGS. 2A and 2B, a frame 6 on which the diaphragm assembly 1A is mounted, is formed through drawing of an aluminum plate of 1 mm thickness. The maximum outer diameter of a flange 61 of the frame 6 is 158 mm and is generally the same size of a frame usually called a 6.5 inch frame. As shown in FIG. 2A, three frame mount holes 62 of 5 mm diameter are formed in the flange 61 at an interval of 120 degrees at the positions remote from the center of the frame 6 by 71 mm. As shown in the cross sectional view of FIG. 2B, an upright portion is integrally formed with the flange 61 at its outer circumference. The inner circumference of the flange 61 is at the position remote from the frame center by 62 mm, and a frame bottom 63 of about 77 mm diameter is formed at the mount depth of about 20 mm.

Formed in the frame bottom 63 area are a hole 64 of 8.2 mm diameter at the frame center and three holes 65 of 6.2 mm diameter at an interval of 120 degrees at the positions remote from the center of the frame 6 by 27.8 mm, the three positions corresponding to the positions of the voice coil mounts of the diaphragm assembly 1A. The hole 64 is used for inserting a damper shaft 7 for the damper, and the three holes 65 are used for inserting magnetic circuit shafts 8 for magnetic circuits.

The damper shaft 7 has a diameter of 8 mm and a total height (length) of 11.6 mm. As shown in FIG. 2B, the damper shaft 7 has at its top center a projection 71 of 2 mm diameter and 1 mm high and a flange 72 of 14 mm diameter and 2 mm thick at the position 1 mm higher than the bottom thereof. The magnetic circuit shaft 8 has a diameter of 5.98 mm and a total height (length) of 19.15 mm. As shown in the cross sectional view of FIG. 3B, the magnetic circuit shaft 8 has a threaded portion 81 of 6 mm depth in the upper central area of the shaft and a flange 82 of 18 mm diameter and 2.15 mm thick at the position 1 mm higher than the bottom thereof. In this embodiment, although the material of the shafts 7 and 8 is aluminum, other desired materials may be selected depending upon the design.

Figure 3A:
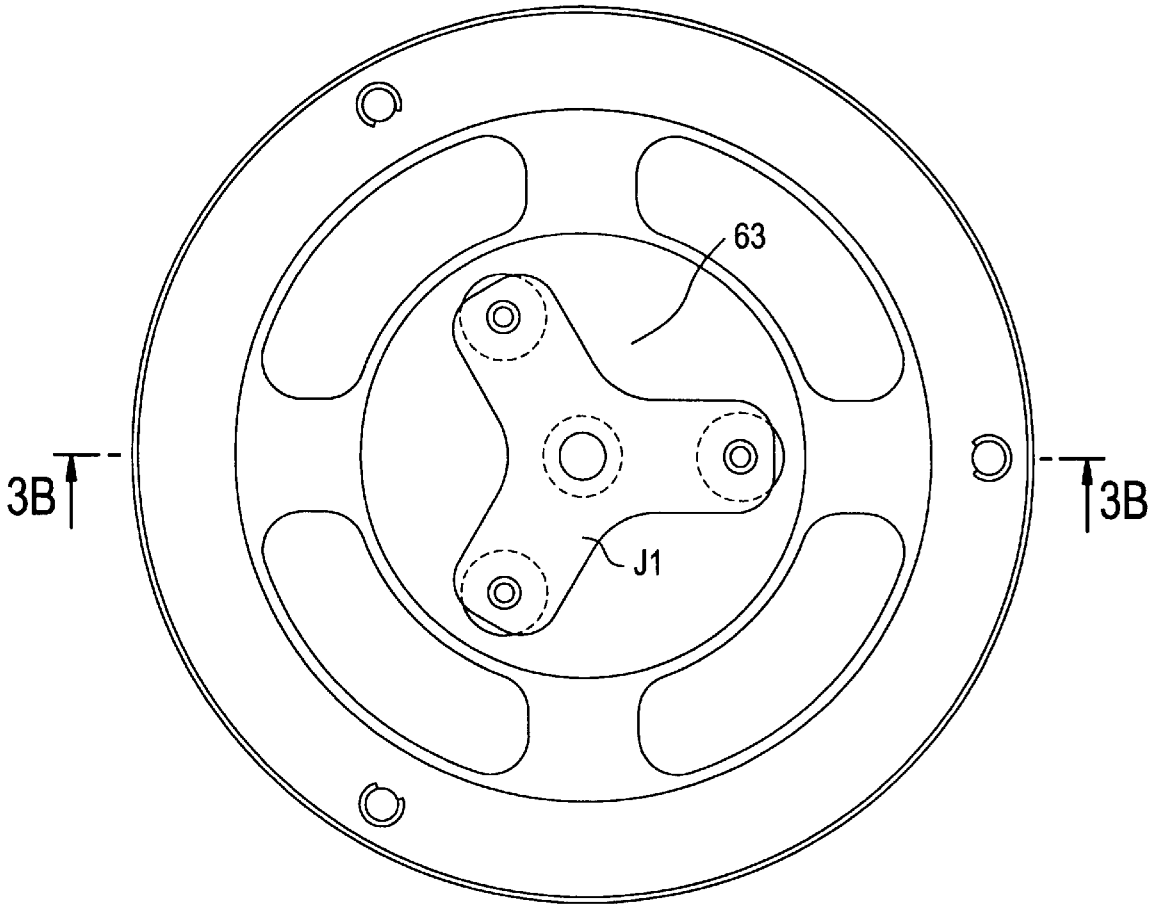
FIGS. 3A and 3B show the frame, a damper shaft, and a magnetic circuit shaft, respectively mounted on the frame bottom.
Figure 3B:
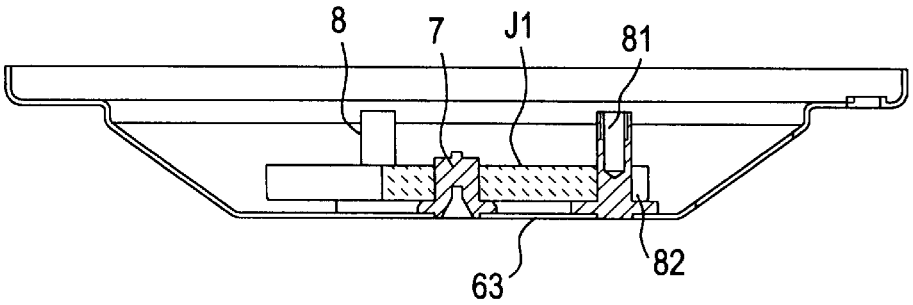

After acrylic based adhesive b1 is coated on the bottom surfaces of the flanges 72 and 82 of the shafts 7 and 8 and on the frame bottom 6 at the area near the holes 64 and 65 for inserting the shafts 7 and 8, the shafts 7 and 8 and the frame bottom 63 are made in tight contact with each other and, as shown in FIGS. 3A and 3B, a positioning jig J1 is fitted around the shafts 7 and 8 to correctly adjust the positions of the shafts 7 and 8. After the adhesive b1 is cured, the positioning jig J1 is dismounted so that the damper shaft 7 and the magnetic circuit shafts 8 are fixedly mounted on the frame bottom 63.

In this embodiment, although the shafts 7 and 8 are fixedly mounted by using adhesive, this fixation may be performed by other means such as caulking, screw threading, integral molding, insert molding, and the like which can be selected as desired depending upon the design.

Figure 4A:
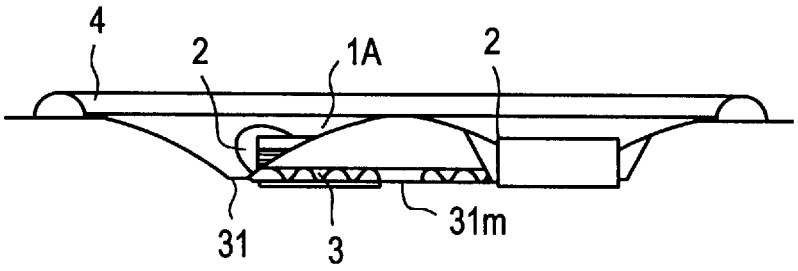
FIGS. 4A to 4C illustrate a process of mounting a diaphragm assembly of the speaker on the frame.
Figure 4B:
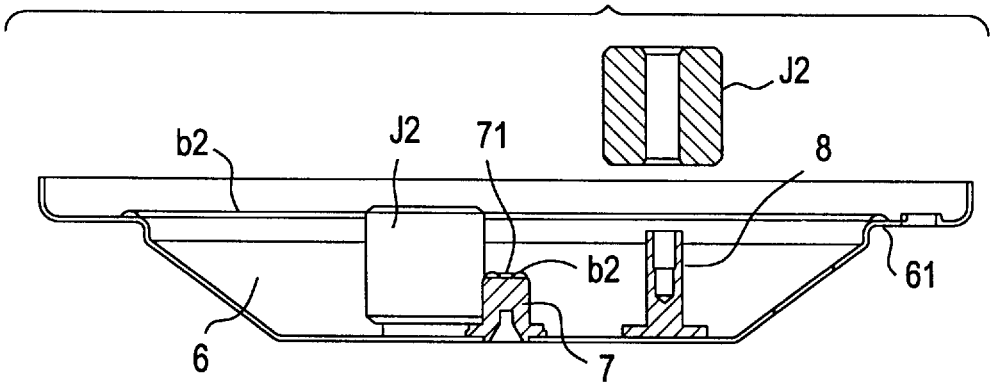
Figure 4C:
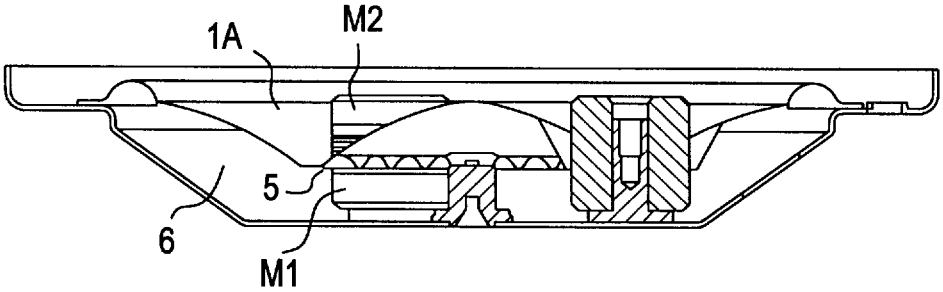

As shown in FIGS. 4A and 4B, the three magnetic circuit shafts 8 mounted on the frame 6 are inserted into voice coil insertion jigs J2 each having an outer diameter of 20.42 mm, an inner diameter of 6.0 mm, and a length of 20 mm. After rubber based adhesive b2 is coated on the whole circumference near the inner circumference of the flange 61 of the frame 6 at a predetermined area (where the edge is adhered) and on the whole circumference near the top outer circumference of the damper shaft 7 at a predetermined area (where the damper is adhered), the inner circumferential area of the voice coil 2 of the diaphragm assembly 1A is fitted around the outer circumferential area of the voice coil insertion jig J2. Therefore, while the diaphragm assembly 1A is disposed at a predetermined position relative to the magnetic circuit shafts 8, the edge 4 and the adhesive margin 31*n* of the damper 3 are adhered to the inner circumference of the flange 61 and to the top circumference of the damper shaft 71.

After the diaphragm assembly 1A is adhered to the frame 6, the voice coil insertion jigs J2 are removed. In this state, the magnetic circuit shafts 8 are disposed at the centers of the voice coils 2. Magnets M1 and M2 and a center plate 5 which are the repulsion magnetic circuit components are fitted around the magnetic circuit shaft 8.

Figure 5:
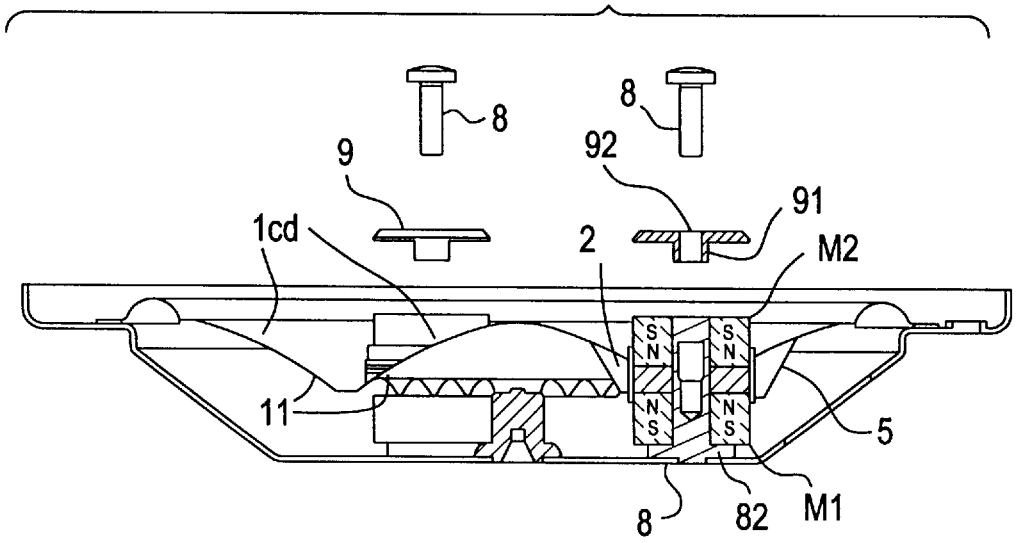
FIG. 5 is a cross sectional view showing the mount state of a repulsion magnetic circuit on the magnetic circuit shaft.

The magnets M1 and M2 each are a ring neodymium magnet having an outer diameter of 19 mm, an inner diameter of 6 mm, and a thickness of 8 mm. The center plate 5 is an iron plate having an outer diameter of 20 mm, an inner diameter of 6 mm, and a thickness of 4 mm. After the repulsion magnetic circuit is mounted on the magnetic circuit shaft 8, a magnet fixer 9 such as shown in FIG. 5 is used for reliably fixing the repulsion magnetic circuit. This magnet fixer 9 is made of aluminum, and has a generally T-character cross sectional shape and a screw hole 92 formed at the central area. Specifically, at the central area of a ring portion having a diameter of 19 mm and a thickness of 2 mm, a projection 91 of 5.9 mm diameter and 3 mm height is formed and the screw hole 92 is formed at the central area.

After the projection 91 of the magnet fixer 9 is inserted into the hole of the upper magnet M2 as shown in FIG. 5, a brass screw B of M4×10 mm is threaded into the screw hole 92. In this manner, the magnets M1 and M2 and center plate 5 are squeezed between the flange 82 of the magnet circuit shaft 8 and the magnet fixer 9.

Figure 6A:
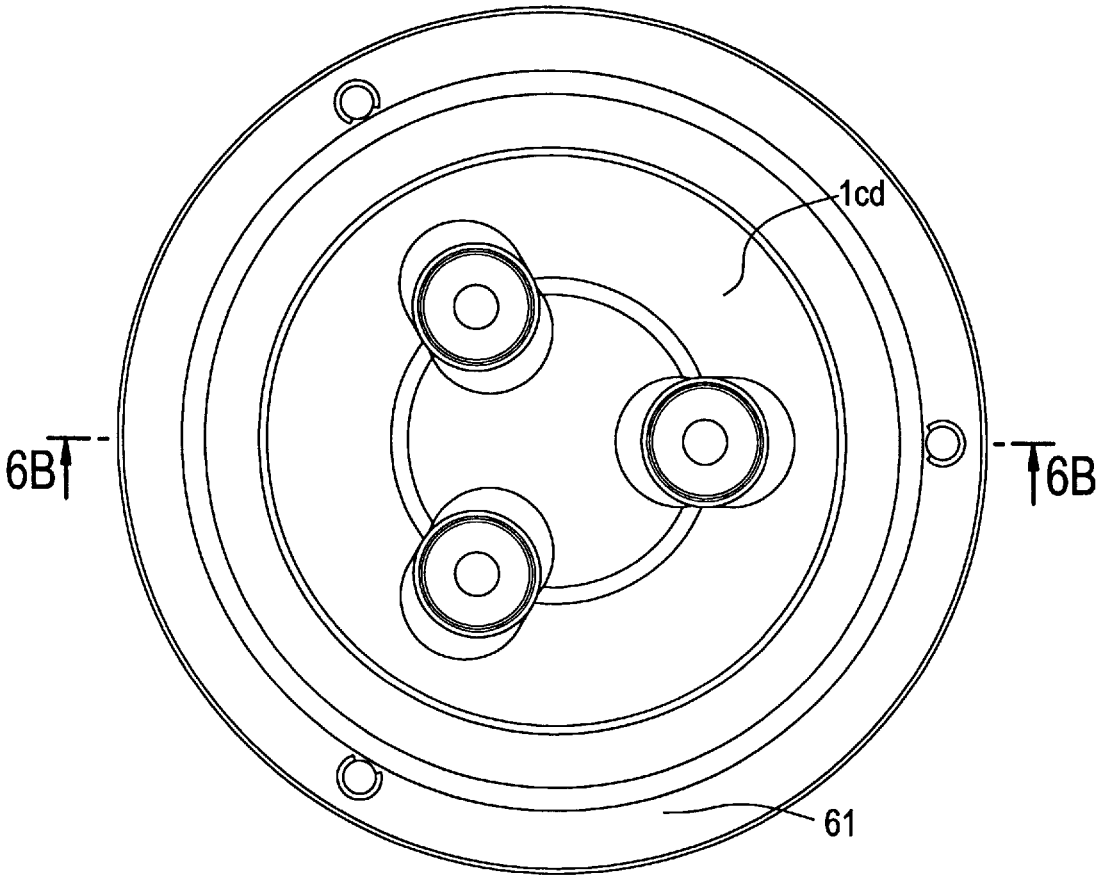
FIGS. 6A and 6B show a finished speaker.
Figure 6B:
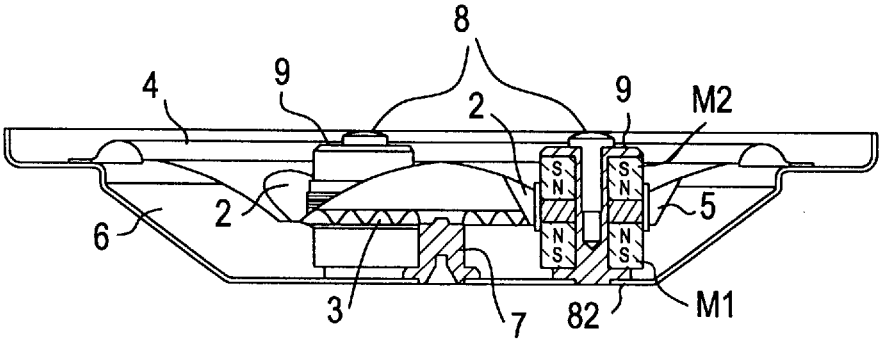

In the state after the repulsion magnetic circuit is fixed, a clearance of about 0.22 mm is formed between the outer circumference of the center plate 5 and the inner circumference of the voice coil 2 so that the voice coil 2 can be moved freely while being driven. A finished speaker is shown in FIG. 6. As described earlier, since the three voice coils 2 are disposed at an interval of 120 degrees along the valley 11 of the diaphragm, three driving points can be obtained.

In this embodiment, although the repulsion circuit is fixed by threading the screw B, it is obvious that the repulsion magnetic circuit may be fixed by adhesion, caulking, or the like depending on the design.

The speaker constructed as above is very thin. The electrical characteristics of this speaker were measured and the reproduction frequency band generally the same as that of a generally used full range one-point drive type cone speaker was obtained.

In the above embodiment, the front shape of the diaphragm is circular. Other desired shapes may be selected depending upon the design. If the area of the diaphragm 1*cd* is broadened, the numbers of repulsion magnetic circuits and voice coils 2 can be increased.

Figure 7A:
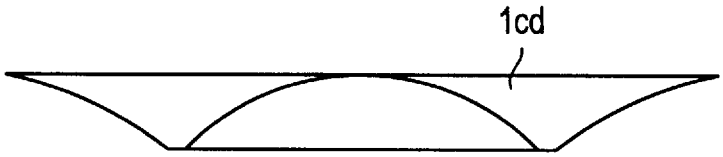
FIGS. 7A to 7C show another embodiment of the speaker in which an edge, a damper, and a diaphragm mount are integrally molded and a diaphragm is mounted on the diaphragm mount.
Figure 7B:
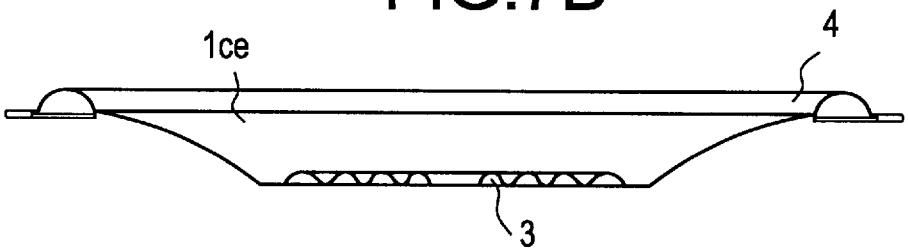
Figure 7C:
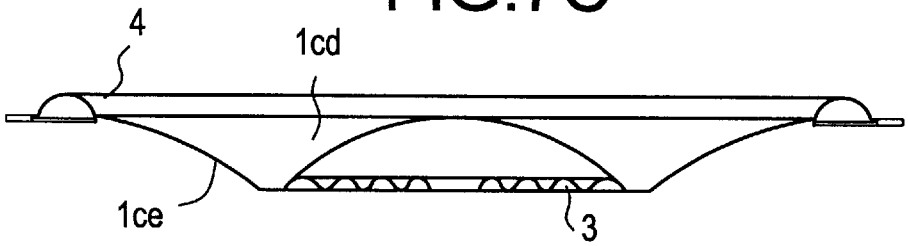
Figure 8A:
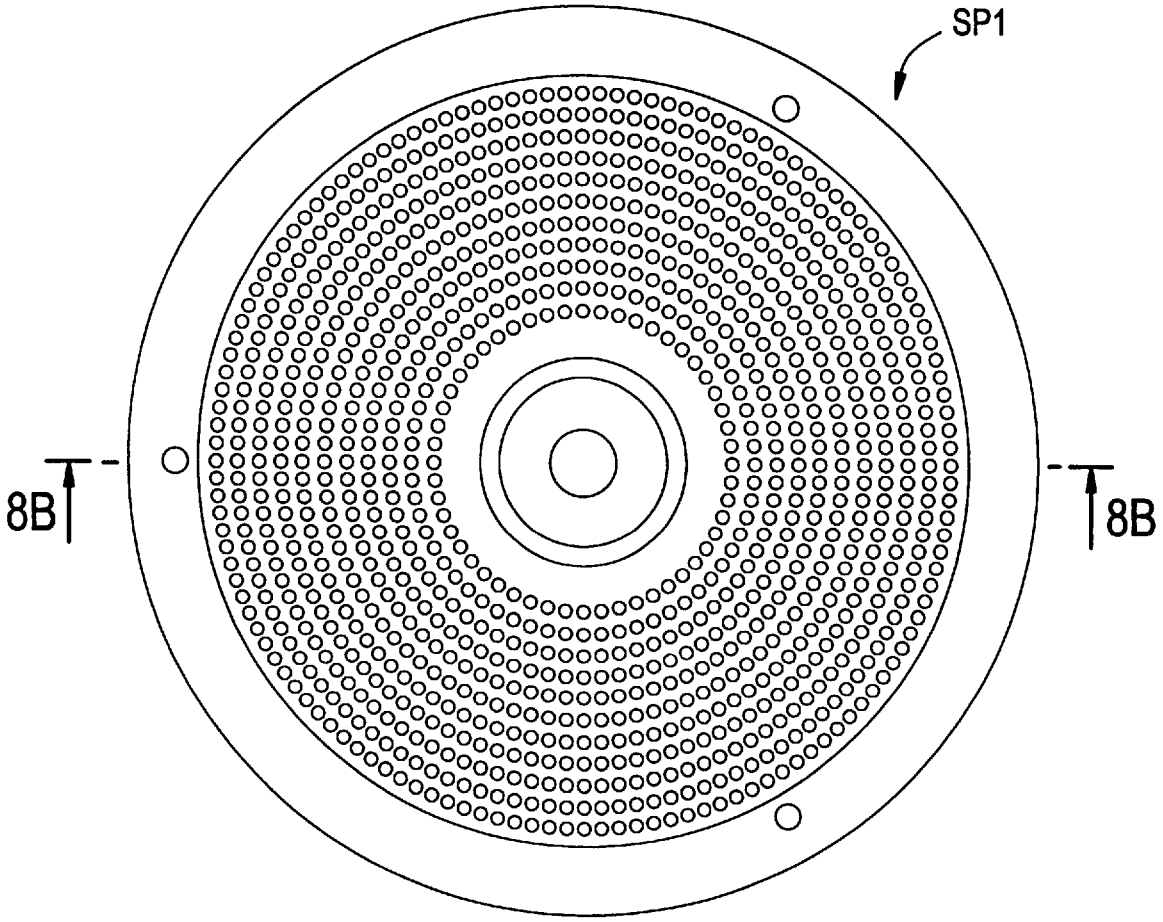
FIG.8A PRIOR ART
FIGS. 8A and 8B show a conventional one-point drive type planar speaker.
Figure 8B:
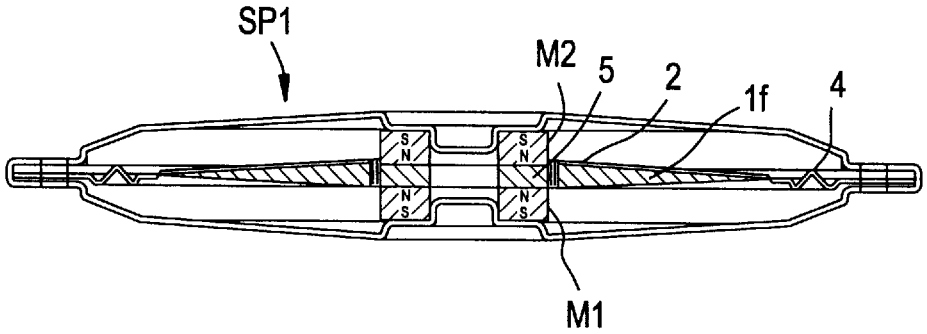
FIG.8B PRIOR ART
Figure 9A:
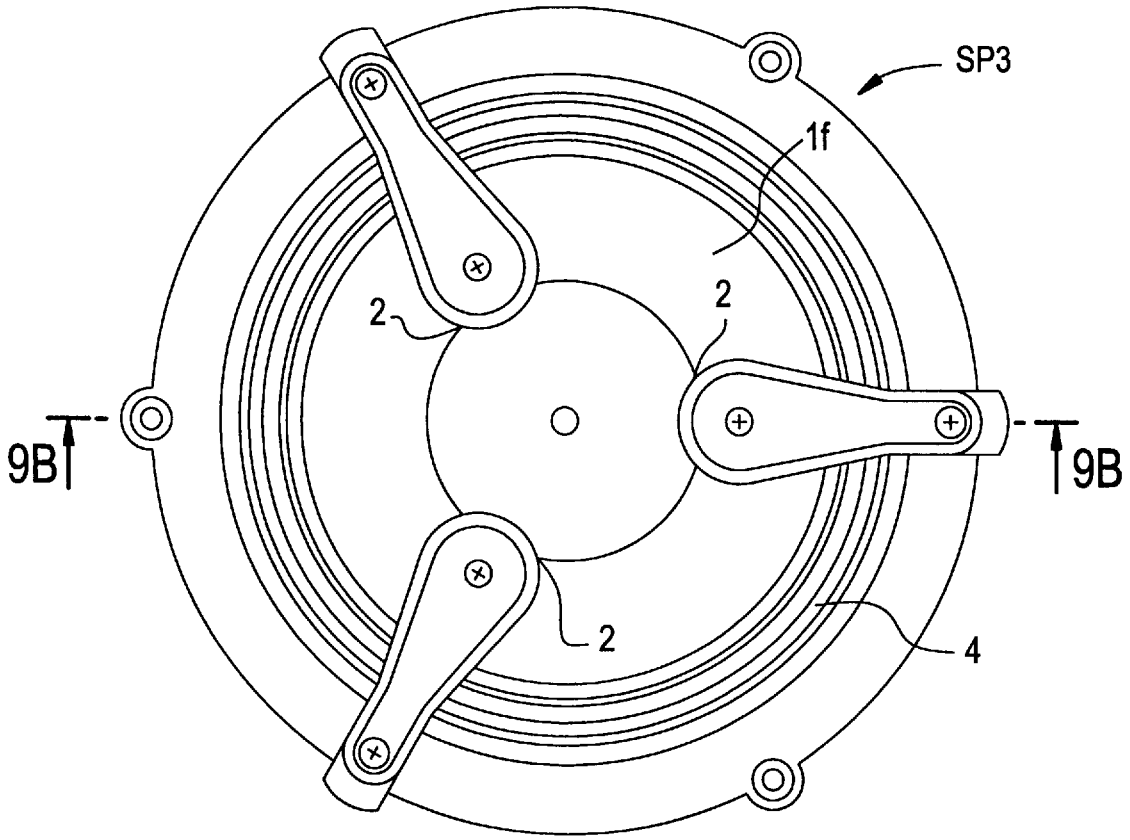
FIGS. 9A and 9B show a speaker proposed by the present inventors and disclosed in JP Patent Application No. 6-147046.
Figure 9B:
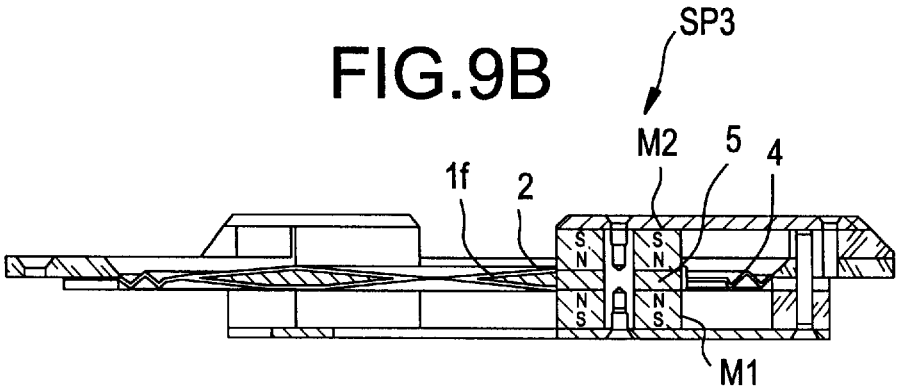

As shown in FIGS. 7A to 7C, an edge 4, a damper 3, and a diaphragm mount 1*cd* may be integrally formed. In this case, after unnecessary portions are cut off by a pressing machine during a trimming process, a diaphragm 1*cd* is placed on the diaphragm mount 1*cd* to mount the former on the latter by adhesive or the like. Since the damper 3 and edge 4 are integrally formed on the diaphragm mount 1*ce*, the number of discrete components can be reduced and the manufacture cost can be lowered.

The speaker configuration of this invention is applicable to a speaker with a general magnetic circuit of an outer or inner magnet type. The main object of the invention is to thin and lighten a speaker, and a voice coil is driven by a repulsion magnetic circuit. It is obvious that a generally used voice coil and magnetic circuit may be used for a speaker which is not necessary for taking a mount depth or the like into consideration.

The speaker having the configuration as above uses the diaphragm 1*cd* having some half apex angle. Therefore, the reproduction frequency band is broadened more than a conventional general planar diaphragm 1*f* and the diaphragm is made lighter than the diaphragm 1*f* of the multi-point drive type planar speaker SP3, so that the performance of the speaker can be improved. Still further, the thickness (mount depth) of the speaker is reduced substantially by a half as compared to a conventional one-point drive type cone speaker. Therefore, the speaker of this invention is most suitable for thinning and lightning.

Specifically, the weight of the diaphragm 1*cd* is about 2 grams generally in the same order of the diaphragm 1*c* of a conventional general one-point drive type cone speaker, and is about a half or smaller of the weight (about 5 grams) of the diaphragm 1*f* of the multi-point drive type planar speaker the inventors have proposed.

If a repulsion magnetic circuit having the same size as the conventional magnetic circuit is used, sound pressure increases more than a conventional speaker. It is therefore possible to obtain a sound pressure in the same order of a conventional speaker even if the size of the magnetic circuit is reduced. The cost of a magnet used for the magnetic circuit, particularly the cost of a neodymium magnet, occupies a large portion of the total cost of a speaker. Therefore, reducing the size of a magnet is very effective for reducing the total cost of a speaker. In addition, this is also effective for lightening the weight of the speaker. A speaker having a weight of about 50% of the one-point drive type cone speaker SP2 can be realized.

Figure 10B:
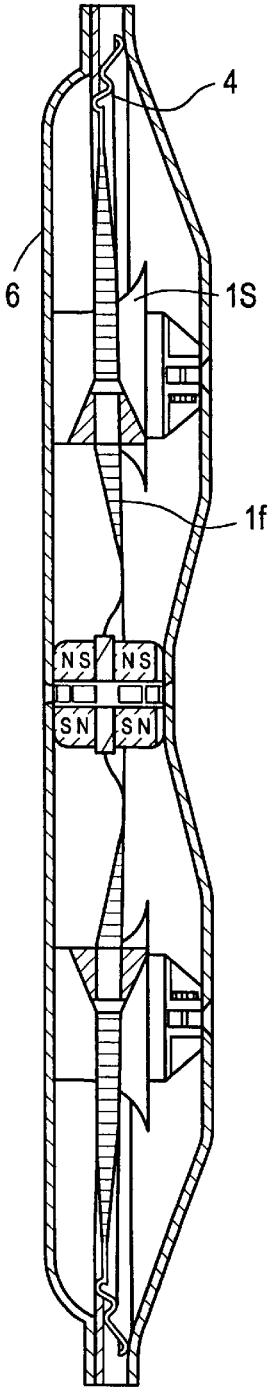
FIGS. 10A and 10B show a conventional speaker obtained by improving a multi-point drive type planar speaker.
Figure 10A:
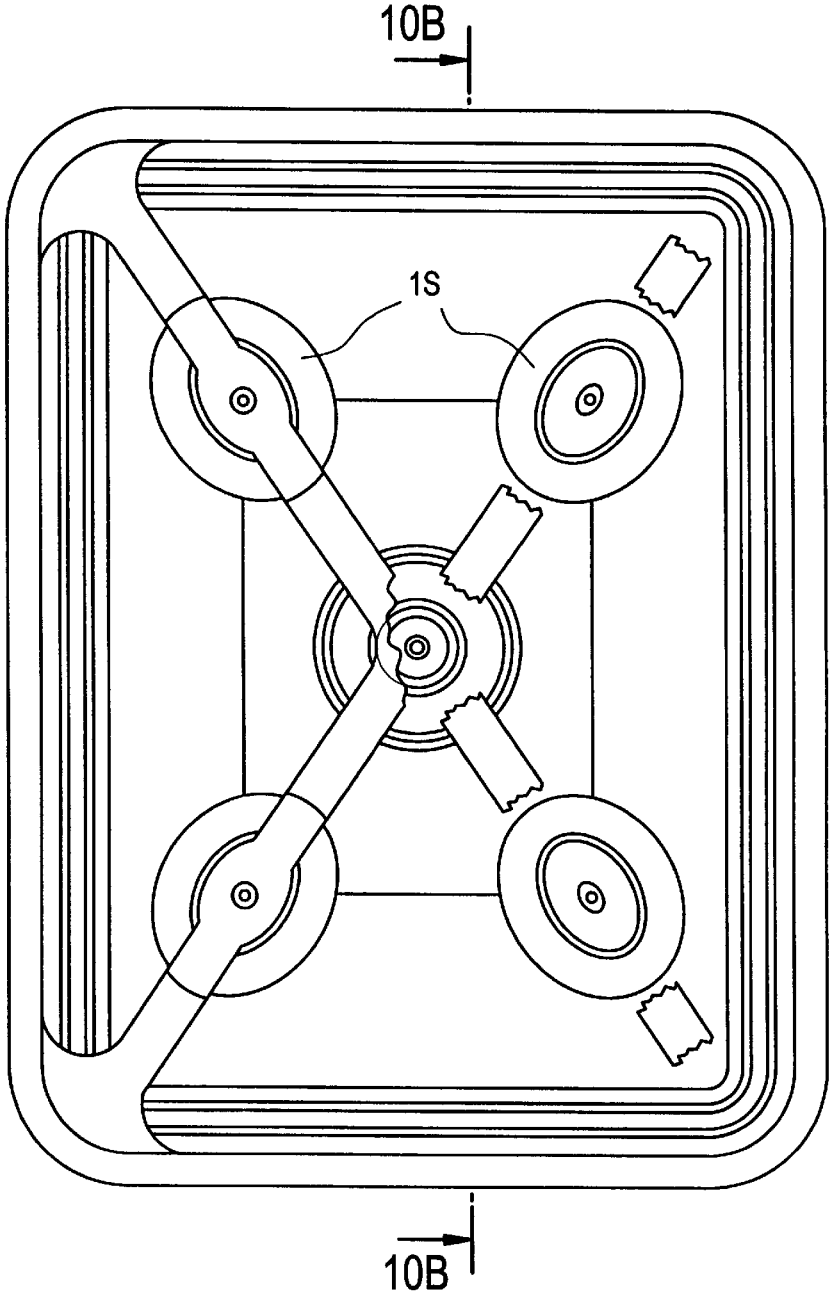

As compared to the planar speaker SP3 or the like the inventors have proposed, the thickness of the speaker of this invention is approximately the same as that of the multi-point drive type planar speaker SP3 with the auxiliary diaphragm is shown in FIGS. 10A and 10B. As compared to the multi-point drive type cone speaker SP2 described with FIGS. 11A and 11B, the thickness of the speaker of this invention can be substantially halved or more, and the speaker is most suitable as a vehicle mount speaker with a limited mount depth.

Now, FIG. 1 is referred to for the following explanation. If the adhesive margin 31 of the damper 3 is molded obliquely like the slope of the diaphragm, the adhesive margin 31 attached to part of the diaphragm, particularly to the slope of the cone 1*c* or the like, conforms to the morphology of the underlying slope because the material of the damper 3 is flexible. Therefore, the cone 1*c* does not vibrate with high fidelity, and at a large signal input, rolling of the cone 1*c* may occur. That is, in the multi-point type speaker a tight tolerance on the placement of the damper in relation to the diaphragm must be taken. For this reason, the multi-point drive type speaker requires a precision higher than a one-point drive type speaker.

However, with the diaphragm configuration of this invention, the flat portion 12 is formed at the bottom of the valley 11, and the adhesive margin 31 of the damper is adhered to this flat portion 12. Accordingly, the damper 3 can be adhered to the diaphragm at high precision so that a multi-point drive type speaker of stable quality can be manufactured with ease.

Further, the diaphragm 1*cd* of the invention has locally different shapes at the areas where the voice coils 2 are disposed, the horizontal planes are formed at the areas where the voice coils 2 are adhered to the diaphragm 1*cd*, and the cut-away portions are formed in the diaphragm 1*cd* at the horizontal planes, at the slopes 13 extending from the horizontal planes, or at other planes. Accordingly, ribs are formed between the dome 1*d* and cone 1*c*, increasing the mechanical strength of the diaphragm 1*cd* and also effectively reducing the weight of the diaphragm 1*cd*. Still further, this rib structure is very effective for coating adhesive on the adhesion area 14 between the voice coil 2 and diaphragm 1*cd*.

Figure 11A:
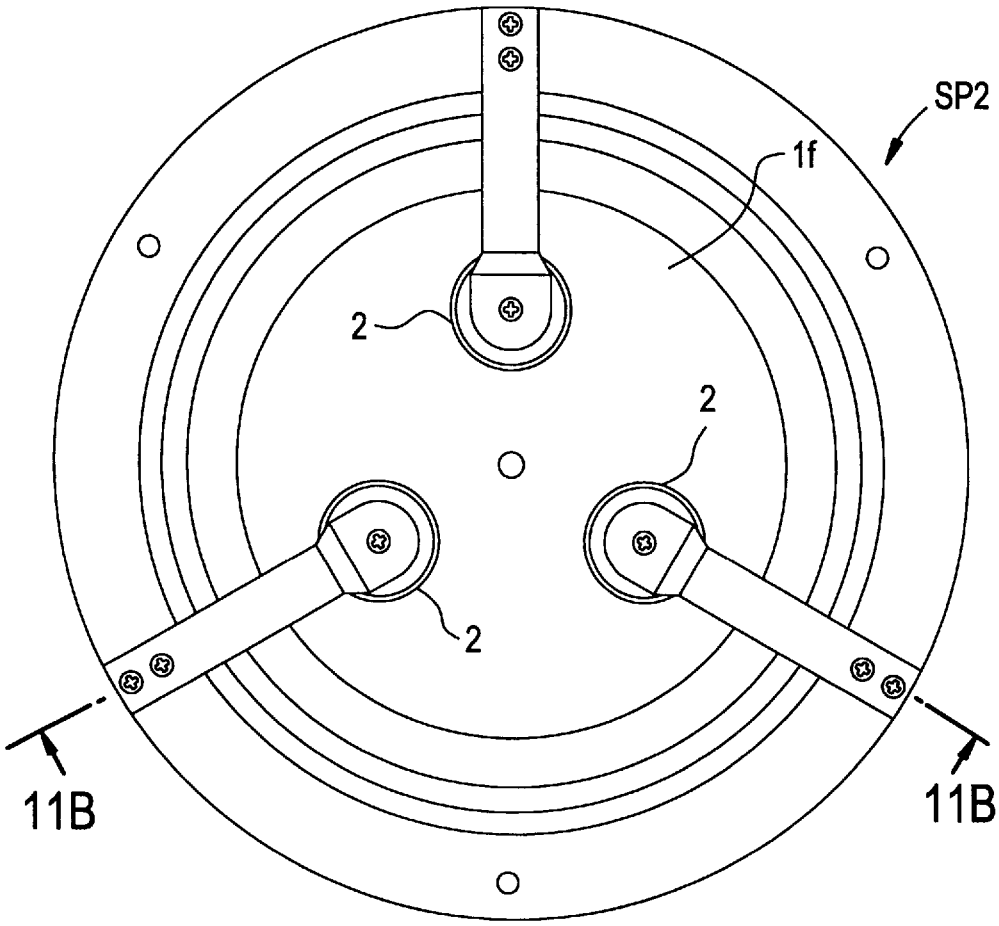
FIGS. 11A and 11B show a conventional multi-point drive type cone speaker for driving a cone diaphragm at multiple points.
Figure 11B:
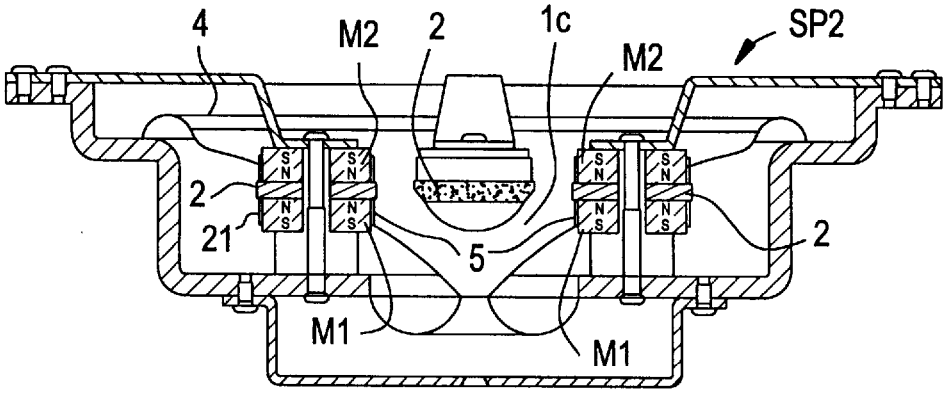

For example, for the multi-point drive type cone speaker SP2 shown in FIGS. 11A and 11B, the adhesion area between the voice coil 2 and diaphragm 1*c* is defined by the hole cut in a sloped surface of the diaphragm 1*c*. Therefore, it is very difficult to coat adhesive uniformly in the form of stripe along the adhesion area, and the control of the nozzle of an adhesive coater becomes complicated. However, with the diaphragm configuration of this invention, the adhesion area between the voice coil 2 and diaphragm 1*cd* is defined by a circular hole cut at the same horizontal level. Accordingly, a conventional general adhesive coater can be used.

Moreover, the adhesive margin 31 at the outer circumference of the damper 3 supporting the diaphragm is positioned at the valley 11 of the diaphragm, and the corrugation portion 32 of the damper is positioned under the dome 1*d*. Accordingly, as compared to the case where the corrugation portion 32 is positioned under the cone 1*c*, the size of the frame bottom 63 can be made smaller. This size reduction improves the space factor in the mount depth direction and greatly facilitates the molding of the frame 6 if it is formed by a pressing machine because of a smaller drawing factor.

Since the corrugation portion 32 of the damper is positioned inside of the dome 1*d*, it becomes possible as shown in FIGS. 7A to 7C to integrally form the edge 4, damper 3, and diaphragm 1*cd*, to remove unnecessary portions by a pressing machine during the trimming process, and to adhere the integral mold to the diaphragm 1*cd* with adhesive or the like. Accordingly, the damper 3 and edge 4 can be used as one component and the number of components can be reduced to lower the cost. In FIGS. 7B and 7C, the area near the voice coil mount is omitted because the configuration is complicated and difficult to understand.

The cone diaphragm and the center cap or the like in the speaker of this invention, having a valley at the junction point with the center cap, is integrally mounted with the center cap, and a plurality of voice coils, preferably three or more voice coils, are radially disposed along the valley or at the area near the valley to drive the diaphragm. Accordingly, the diaphragm with a relative small apex angle can be used and the reproduction frequency band can be broadened more than a planar diaphragm. Further, the weight of the diaphragm can be greatly reduced and the sound pressure can be increased.

Still further, the speaker can be lightened and thinned so that it is most suitable for a vehicle mount speaker. In addition, the cost can be lowered.

What is claimed is:

1. A loudspeaker comprising:

a diaphragm including a sloped portion;

voice coils mounted to at least two points of said diaphragm so that at least part of each of said voice coils is disposed on the sloped portion of said diaphragm; and magnetic circuit units, each for generating a magnetic field for each of said voice coils, wherein the sloped portion on which at least part of each of said voice coils is disposed is provided with a voice coil mount which has a conical slope extending a horizontal flat peripheral edge of an opening through which each of said voice coils is inserted, the horizontal flat peripheral edge of the opening being a joint line between each of said voice coils and said diaphragm.

2. A loudspeaker according to claim 1, wherein each of said magnetic circuit units comprises two magnets which are magnetized in their axial directions so that the same magnetic polarity of said two magnets face to each other to generate a repelling magnetic field.

* * * * *